US008459165B2

(12) United States Patent
Doll et al.

(10) Patent No.: US 8,459,165 B2
(45) Date of Patent: Jun. 11, 2013

(54) BREECH GUIDES FOR USE WITH BREECH ASSEMBLIES AND FIREARMS INCLUDING SUCH BREECH GUIDES

(75) Inventors: Stefan Doll, Oberndorf (DE); Martin Stussak, Schomberg (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 13/357,308

(22) Filed: Jan. 24, 2012

(65) Prior Publication Data

US 2012/0210859 A1 Aug. 23, 2012

Related U.S. Application Data

(63) Continuation of application No. PCT/EP2011/000719, filed on Feb. 15, 2011.

(30) Foreign Application Priority Data

Feb. 26, 2010 (DE) ..... 10 2010 009 426

(51) Int. Cl.
*F41A 3/00* (2006.01)

(52) U.S. Cl.
USPC ..... 89/17; 89/169; 89/179; 89/180; 89/186

(58) Field of Classification Search
USPC ..... 89/169, 179, 180, 186, 187.01, 199, 89/11, 24, 17
See application file for complete search history.

(56) References Cited

U.S. PATENT DOCUMENTS

| | | | | |
|---|---|---|---|---|
| 3,289,535 | A | 12/1966 | Hupp | |
| 3,407,702 | A | 10/1968 | Cermak et al. | |
| 3,563,132 | A | 2/1971 | Cashen et al. | |
| 4,982,649 | A | 1/1991 | Koine | |
| 2007/0033850 | A1 | 2/2007 | Murello et al. | |
| 2010/0319527 | A1 * | 12/2010 | Giefing | 89/185 |

FOREIGN PATENT DOCUMENTS

| | | |
|---|---|---|
| CH | 51131 | 8/1911 |
| DE | 419803 | 10/1925 |
| DE | 1174656 | 7/1964 |
| DE | 1678508 | 5/1970 |
| DE | 3835556 | 4/1990 |
| DE | 19726032 | 1/1998 |
| DE | 10349160 | 8/2005 |
| DE | 4345591 | 8/2008 |

OTHER PUBLICATIONS

International Searching Authority, "Written Opinion," issued in connection with International Patent Application No. PCT/EP2011/000719, mailed on Jun. 8, 2011, 10 pages.

(Continued)

*Primary Examiner* — Benjamin P Lee
*Assistant Examiner* — Benjamin Gomberg
(74) *Attorney, Agent, or Firm* — Hanley, Flight and Zimmerman, LLC

(57) ABSTRACT

Breech guides for use with breech assemblies and firearms including such breech guides are disclosed. An example breech guide for use with a breech assembly of a firearm includes a support element positioned within the breech assembly and a control element on the support element, the control element is adapted to control a cartridge-feeder mechanism of the firearm. The example breech guide includes a guide element on the support element. The guide element is adapted to guide the breech assembly relative to guide rails of the firearm. The support element extends along an axis of symmetry substantially perpendicular to a bore axis. The control element and the guide element being substantially coaxially positioned relative to the axis of symmetry.

19 Claims, 9 Drawing Sheets

OTHER PUBLICATIONS

International Searching Authority, "Search Report," issued in connection with International Patent Application No. PCT/EP2011/000719, mailed on Jun. 8, 2011, 3 pages.

German Patent and Trademark Office, "Office Action," issued in connection with German Patent Application No. 102010009426.9, mailed on Oct. 29, 2010, 5 pages.

* cited by examiner

BREECH GUIDES FOR USE WITH BREECH ASSEMBLIES AND FIREARMS INCLUDING SUCH BREECH GUIDES

RELATED APPLICATION

This patent is a continuation of International Patent Application Serial No.: PCT/EP2011/000719, filed Feb. 15, 2011, which claims priority to German Patent Application 10 2010 009 426.9, filed on Feb. 26, 2010, both of which are hereby incorporated herein by reference in their entireties.

FIELD OF THE DISCLOSURE

This patent relates generally to breech guides and, more specifically, to breech guides for use with breech assemblies and firearms including such breech guides.

BACKGROUND

Some known breech assemblies that guide a breech of a firearm include DE 103 49 160 B3, which is assigned to the assignee of the present patent. DE 103 49 160 B3 describes a weapon housing or component having a hollow body profile that accommodates different weapon components. The weapon housing or component includes a rail (e.g., a slide rail) having a cross-sectional profile that engages in a corresponding groove of a breech element. The rail may be a roller rail that guides the breech element.

DE 43 45 591 B4, assigned to the assignee of the present patent, describes a self-loading grenade launcher having a breech head that includes a centrally located curved lever catch. The lever catch can be a roller rotatable about a vertical axis. To control the supply of ammunition to the weapon via a belt fed conveyor, the roller runs and/or is positioned in a curved control groove of a curved lever. To lead and/or guide the recoil action of the weapon along an axis, a pass rod is mounted in a steel block that extends through the casing and/or housing of the grenade launcher. Rearward axial movement of the pass rod causes and/or guides the weapon recoil. U.S. Pat. No. 3,563,132 describes a curved lever with a control rail that extends between two pin rollers on a breech head.

DE 1678508 B describes a gas operated loading mechanism with a breech actuatable using a gas piston. A breech head and breech base each include laterally extending control legs or protrusions that slide in corresponding grooves of the weapon housing or casing. To advance a belt-feed mechanism when the breech returns from recoil via a gear wheel of the firearm, the breech base includes a roller that enters a curved groove on the belt-feed mechanism.

DE 197 26 032 A1 describes a breech system for a MKM 88 firearm having a gas-operated loading mechanism. The loading mechanism includes a lateral cam and control tunnel or portion positioned on a breech base. To reduce slow-down friction of the breech head, the cam may prevent rotation of the breech head control latch. A breech sliding nose guides the movement of individual elements of the breech assembly. The weapon housing or casing may include lateral sliding rails in which the breech assembly and/or unit is mounted and/or positioned.

DE 38 35 556 A1 describes a direct-pull breech system for firearms. To enable rectilinear guidance of the breech, the firearm includes two runners. CH 51 131 A describes a direct-pull breech system with locking lugs that include inclined locking surfaces.

DETAILED DESCRIPTION

Figure 1:
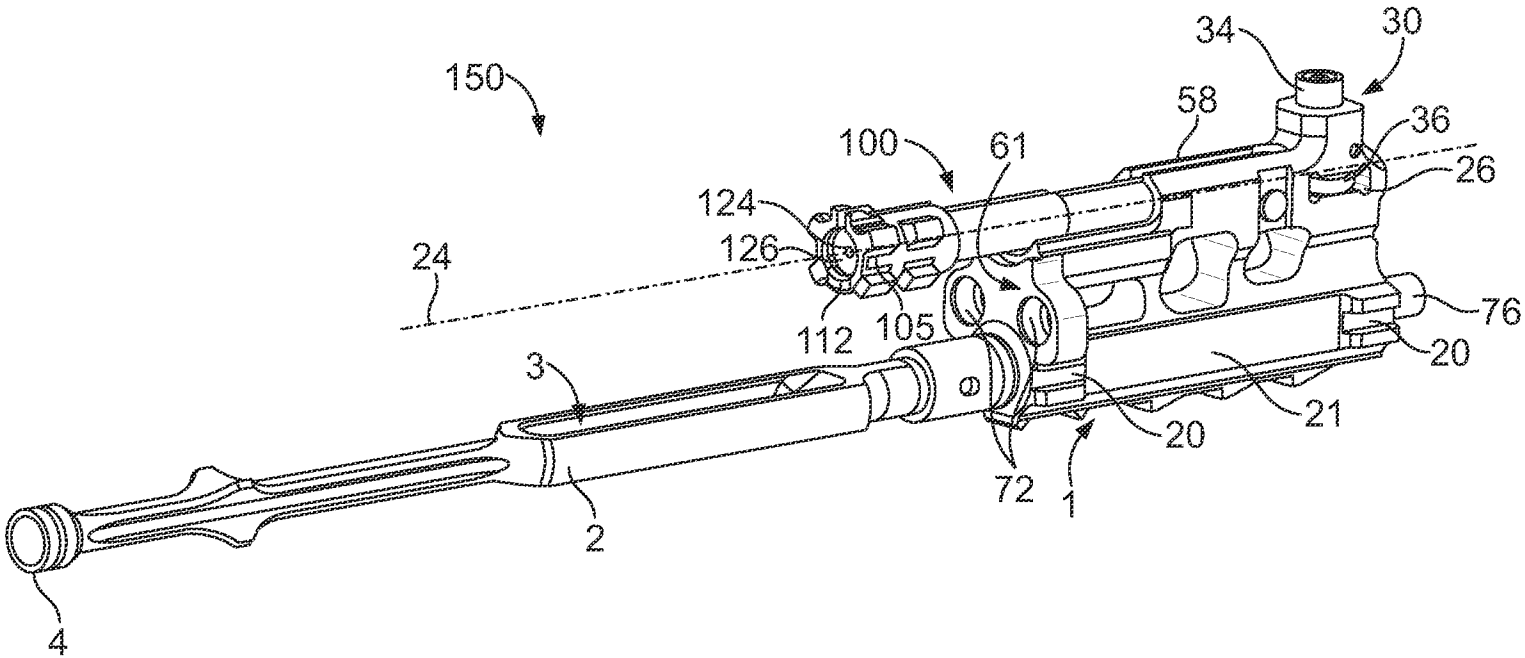
FIG. 1 depicts a perspective view from the front of an example breech assembly having an example breech guide in accordance with the teachings of this disclosure.
Figure 2:
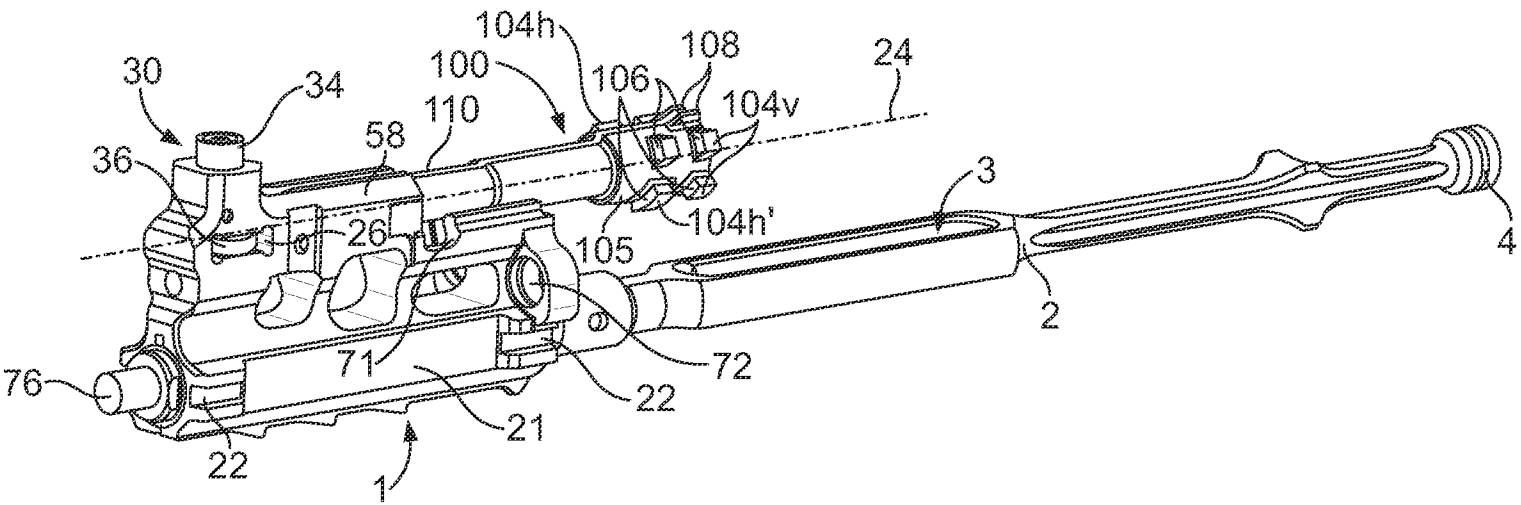
FIG. 2 depicts a perspective view from the rear of the example breech assembly of FIG. 1.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity. Additionally, several examples have been described throughout this specification. Any features from any example may be included with, a replacement for, or otherwise combined with other features from other examples. Further, throughout this description, position designations such as "above," "below," "top," "forward," "rear," "left," "right," etc. are referenced to a firearm held in a normal firing position (i.e., wherein the "shooting direction" is pointed away from the marksman in a generally horizontal direction) and from the point of view of the marksman. Furthermore, the normal firing position of the weapon is always assumed, i.e., the position in which the barrel runs along a horizontal axis.

The examples disclosed herein relate to example breech guide devices for an example breech assembly and/or arrangement that may be used with weapons and/or firearms. The weapons and/or firearms may be automatic weapons, semi-automatic weapons, etc.

The examples disclosed herein relate to an example breech assembly for use with an automatic weapon having a gas-operated loading mechanism (e.g., a gas piston, a gas tube, etc.).

Some of the components of the examples disclosed herein are depicted in FIGS. 1-5.

An example breech assembly 150 includes a breech base 1 and/or an axially displaceable breech head 100. In this example, a gas tube, pressure gas tubing and/or piston rod 2 connects and/or couples a front end of the breech base 1 to a gas source (e.g., a tap at the barrel) of the weapon. After the firearm is fired, some of the exhaust gas exerts a pressure through and/or within an outlet cylinder (not shown) of a gas block and onto an end face of a piston 4 coupled to the piston rod 2. The pressure and/or force that acts on the piston 4 in turn moves the piston rod 2. Movement of the piston rod 2 moves and/or actuates the breech base 1 in a housing and/or casing 6 (See FIG. 3) toward the rear of the firearm and/or weapon.

Figure 3:
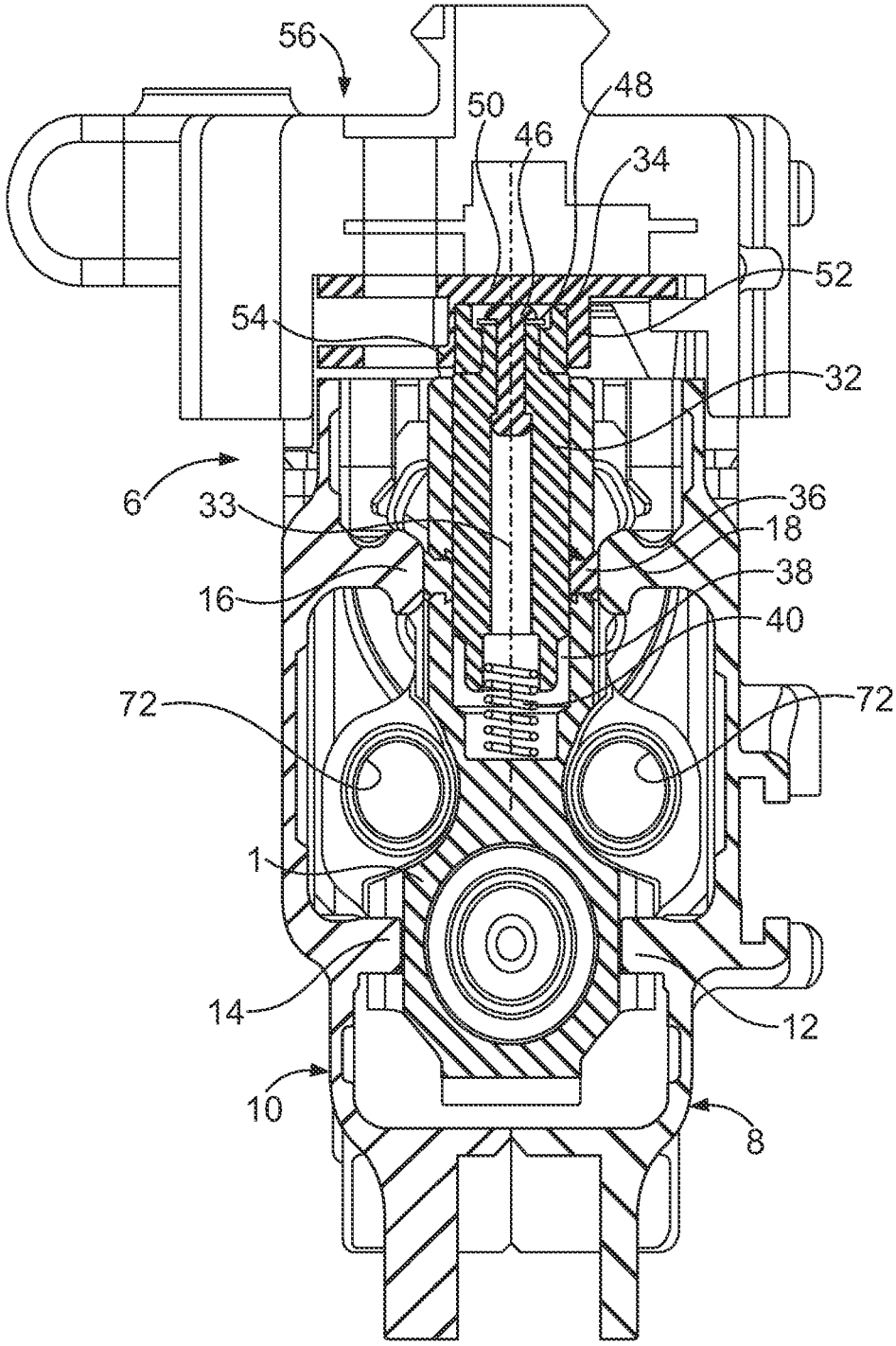
FIG. 3 depicts a cross-sectional view of an example weapon casing through a section of the example breech assembly.

As shown in FIG. 3, the casing 6 includes two casing semi-monocoques, portions and/or elements 8, 10. In this example, the casing portions 8, 10 include lower and upper guide rails 12, 14, 16 and 18 that guide movement of the breech base 1 as the breech base 1 moves during the loading and/or unloading process (e.g., moves back and forth as the firearm cycles relative to the casing 6).

To enable the breech base 1 to be horizontally guided within the casing 6 in the longitudinal direction along a center line of a bore axis 24, the lower guide rails 12, 14 engage and/or are received by first and second grooves and/or guide grooves 20, 22 (FIGS. 1, 2) on the left and right side of the breech base 1.

A space, free-space, aperture and/or groove 21 (FIG. 1) positioned between the first and second grooves 20 and 22 enables the breech base 1 to move with relatively low friction and substantially prevents the build-up of contaminants therein. In this example, as the breech base 1 moves relative to the casing 6, the first and second grooves 20, 22 and the corresponding lower guide rails 12, 14 interact in a claw-like and/or removing manner to substantially remove any sediment or debris and to enable movement of the breech base 1 to be substantially unhindered. Additionally, the interaction between the first and second grooves 20, 22 and the corresponding lower guide rails 12, 14 substantially prevents the build-up of any sediment adjacent the area in which the breech base 1 moves during the loading and/or unloading process. By substantially removing sediment and/or keeping the path of the breech base 1 relatively clear, frictional forces and/or an amount of friction encountered when moving the breech base 1 relative to the casing 6 is relatively low and/or minimized. To enable the breech base 1 to be supported and/or guided relative to the casing 6 and to substantially prevent the breech base 1 from jamming in the casing 6 during the loading and/or unloading process, the first and second grooves 20 and 22 are positioned at the front and rear ends of the breech base 1.

In this example, a breech guide 30 is positioned at an upper rear end of the breech base 1. The breech guide 30 includes a guide shaft, shaft, elongated member and/or element 32 (FIG. 3). A first roller, guide, guide roller, control element and/or element 34 is rotatably coupled and/or retained at an upper end of the shaft 32. The shaft 32 passes through a second roller, guide, guide roller, control element and/or element (e.g., equally crowned guide roller) 36 that is positioned and/or axially retained in a transversal recess 26 (FIGS. 1, 2) of the breech base 1. The second roller 36 is rotatably coupled and/or seated on the shaft 32. The second roller 36 laterally protrudes from and/or extends beyond sides of the breech base 1.

In this example, the shaft 32 and the first and second rollers 34 and 36 are substantially coaxially aligned and/or positioned relative to an axis of symmetry 33 that extends substantially perpendicularly relative to the bore axis 24. The shaft 32 is axially movable in a retaining aperture 38 of the breech base 1 and upwardly biased by a biasing element or spring 40. The shaft 32 is movable against a force of the spring 40 into and/or relative to the breech base 1 to enable the shaft 32 to be retained and/or received within the retaining aperture 38 and/or the breech base 1.

In this example, an axial travel range is defined by a recess 42 (FIG. 4) on an outer surface and/or outside of the shaft 32. A locking pin or stop 44 is transversally positioned through the breech base 1 adjacent the recess 42. Upper and lower surfaces or faces of the locking pin 44 and the recess 42 guide, restrict and/or retain movement of the shaft 32 relative to the retaining aperture 38. The recess 42 and/or locking pin 44 may also prevent the shaft 32 from being urged out of the retaining aperture 38 by the spring 40. In this example, the first roller 34 is rotatably coupled and/or fixed to the upper end of the shaft 32 using a rivet and/or fastener 46 and a washer and/or retainer 48. However, the first roller 34 may be coupled to the upper end of the shaft 32 in any other suitable way.

In this example, the first roller 34 engages in a U-shaped guide gate, cam or curved lever 50. Specifically, outer and/or convex surfaces of the first roller 34 are received and/or retained by inner and/or peripheral edges and/or surfaces of side or first and second lever legs or portions 52 and 54 of the lever 50. To enable the lever 50 to drive a cartridge feed mechanism as the breech base 1 advances and retracts, the first roller 34 acts as a drive cam that transversally moves the lever 50 back and forth relative to the bore axis 24. Depending on the direction of motion, the first and second lever legs 52, 54 transfer transverse forces onto the first roller 34 and through the shaft 32 onto the breech base 1. Forces being transferred to the first roller 34, urge and/or tilt (e.g., transversally tilt) the shaft 32 to the side of the casing 1 (e.g., right or left). To substantially prevent the transverse forces from affecting the guide properties and mobility of the breech base 1 along the bore axis 24, the second roller 36 substantially transfers lateral loads to the casing 6 by rolling and/or engaging on the upper guide rails 16, 18. The interaction between the second roller 36 and the upper guide rails 16, 18 substantially prevents any jamming from occurring between the first and second grooves 20, 22 and the lower guide rails 12, 14. The functionality of the first roller 34 (e.g., controlling and transporting function) may cause minimal friction that slows and/or retards the movement of the breech base 1 in the casing 6.

The first and second rollers 34, 36 may be cambered rollers that substantially ensure that the breech base 1 moves smoothly. If the first lever leg 52 transfers a left acting force on the right side of the first roller 34, the second roller 36 moves toward and/or abuts the left upper guide rail 16 (e.g., the first and second rollers 34, 36 are moved to the opposite side and/or to the left).

A smooth guiding function of the breech base 1 is substantially ensured by sizing and/or dimensioning the distance(s) between the facing edges or surfaces (e.g., inwardly facing surfaces) of the upper guide rails 16, 18 and the facing edges or surfaces (e.g., inwardly facing surfaces) of the first and second lever legs 52, 54 to provide at least some play for the first and second rollers 34 and/or 36. Surfaces (e.g., cambered roller surfaces) of the first and second rollers 34, 36 substantially ensure that the breech base 1 is slightly tilted and/or at an angle relative to the casing 6 to enable a clean and/or smooth rolling function of the breech base 1 relative to the casing 1. When the first and second rollers 34, 36 move within and/or relative to the upper guide rails 16, 18 and the first and second lever legs 52, 54, the first and second rollers 34, 36 may be slightly tilted and/or at an angle relative to the sides (e.g., guide sides) of the upper guide rails 16, 18 and inner edges of the first and second lever legs 52, 54.

In this example, the lever 50 is positioned adjacent to and/or in a lid 56. The lid 56 may be swiveled and/or hinged and may retain a belt feeder mechanism (not shown). Because the spring 40 enables the shaft 32 and the first roller 34 to be retractable and/or movable in the breech base 1, the lid 56 may be closed in any breech position without the possibility of damaging the lever 50 and/or the first roller 34. For example, if one of the first or second lever legs 52, 54 arrives at and/or is positioned adjacent to the first roller 34, the shaft 32 and the first roller 34 are moved and/or pushed into the retaining aperture 38 of the breech base 1. During the loading movement of the breech base 1 along the bore axis 24, an upper front portion of the first roller 34 slides along a lower face and/or surface of the first and second lever legs 52 and/or 54 until the first roller 34 is in a path of and/or engagement with the lever 50. The engagement between the first roller 34 and the lever 50 urges the first roller 34 within the retaining aperture 38 against the force of the spring 40.

In some examples, to improve rolling characteristics of the first and second rollers 34 and/or 36, an outer surface of the shaft 32 and/or the inner surfaces of the first and second rollers 34 and/or 36 have sliding, coated, machined, etc., surfaces. The first and second rollers 34 and/or 36 may be coupled to the shaft 32 using a roller bearing or other suitable coupling. In other examples, the first and second grooves 20 and/or 22 may include roller bearings (not shown) to further reduce frictional resistance of the guide rails 12, 14, 16 and/or 18 when the breech base 1 moves relative to the casing 1. Additionally or alternatively, control and/or guide elements (not shown) that abut inner edges of the lever 50 may move and/or slide relative to the shaft 32. The guide elements may be symmetrical relative to a plane of symmetry defined by and/or between the bore axis 24 and the axis 33.

The examples disclosed herein include a turning bolt and/or stud breech having the axially displaceable breech head 100. The breech head 100 is rotatably retained and/or guided in a guide case or tube 58 between a locked and unlocked position. The guide case 58 (FIG. 1) is positioned at an upper side and/or portion of the breech base 1. In this example, the breech head 100 includes two consecutive crowns or breech studs 104 having front or first breech studs **104*v* and rear or second breech studs 104*h*. While the breech studs 104 include four first breech studs 104*v* and four second breech studs 104*h*, any other number (e.g., 1, 2, 3, etc.) of breech studs may be used instead. The first and second breech studs 104*v* and 104*h* are in pairs at particular positions (e.g., two o'clock position, four and/or five o'clock position, seven and/or eight o'clock position and/or ten and eleven o'clock position). Lateral gaps and/or grooves longitudinally extend between the first and second breech studs 104*v*, 104*h* to enable locking with a locking piece 200 and/or to guide the breech head 100 relative to the casing 6**.

The disclosed examples may be used in connection with a firearm having an open bolt where, prior to firing a round, the breech assembly 150 is positioned behind the ammunition to be fed into a cartridge chamber and, after initiating the firing of a shot, the breech assembly 150 advances and feeds the ammunition into a cartridge chamber. After the breech assembly 150 is secured and/or locked, the cartridge is fired.

FIGS. 1, 2, 4 and 5 depict the breech head 100 in an unlocked position and FIGS. **6*d*-6*f* depict the breech head 100 in a locked position. During movement of the breech assembly 150 in the casing 6, the upper guide rails 16, 18 extend into lateral gaps between the first and second breech studs 104*v* and 104*h* (e.g., the gaps at the three o'clock position and the nine o'clock position) to guide and/or substantially prevent unwanted rotation of the breech head 100**.

In this example, feeding lugs 108 are positioned at the twelve o'clock position on a front end of the breech head 100. A cartridge ejector slot 110 is defined between the feeding lugs 108. The feeding lugs 108 supply cartridges to the firearm and an ejector (not shown) on the casing 6 ejects the cartridge case from the firearm as the breech base 1 moves rearwardly during the unloading process. In this example, the breech head 100 includes two feeding lugs 108 that enable stable guidance of a cartridge when feeding and/or transporting ammunition into the weapon.

Figure 7:
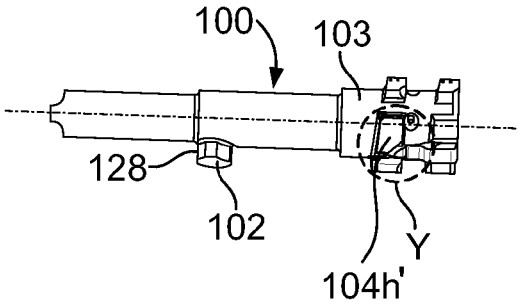
FIG. 7 depicts a side view of an example breech head.

In this example, rotation of the breech head 100 is guided and/or caused by a control pin, pin and/or extension 102 (See FIGS. 4, 5 and 7) that protrudes downwardly into a control slot, slot, aperture, groove or gate 60 of the breech base 1. Depending on the direction of motion and/or operating condition of the weapon and movement between the breech head 100 and the breech base 1, the pin 102 is moved and/or deflected into different rotational positions by interacting with the slot 60. The slot 60 includes a front linear guide zone and/or first slot portion 66 and a rear linear guide zone and/or second second slot portion 68. The first and second slot portions 66 and 68 are connected by a lower guide edge and/or first slot surface 62 and an upper guide edge and/or second slot surface 64. The first slot surface 62 may be used in the locking process and the second slot surface 64 may be used in the unlocking process. Transverse to the bore axis 24, a flat face or surface 70 is arranged and/or positioned at the rear end of the first slot portion 66. To substantially prevent rotational momentum and/or forces from transferring to the breech head 100 from the advancing breech base 1 and/or the pin 102 in the first slot portion 66, the flat surface 70 interacts with a rear and/or front face or pin surfaces 128 (FIG. 7) of the pin 102.

In this example, the pin 102 includes a wedge-shaped, radially outward expanding cross-sectional profile that engages in and/or interacts with a corresponding profile of the slot 60 and/or the first and/or second slot portions 66 and/or 68. To substantially prevent the breech head 100 from tilting, the breech head 100 may be held and/or secured relative to the slot 60 in a dovetail guide, for example. When there is a small overlap between the end of the breech head 100 and the guide case 58, using the examples disclosed herein, the breech head 100 is substantially prevented from being levered and/or moved from the guide case 58.

In this example, to remove the breech head 100, an opening and/or removal opening 71 is positioned at a far end of the second slot portion 68. The pin 102 can be removed by rotating the breech head 100 in the guide case 58 and positioning the pin 102 in the opening 71 to enable the breech head 100 to be forwardly removed from the guide case 58.

The breech head 100 defines a firing pin channel 116 that extends substantially coaxially relative to the bore axis 24. A firing pin 118 is moveable and/or slidable within the firing pin channel 116. The firing pin 118 may include an end and/or ball head 120 positioned in a retaining bearing or recess 59. The ball head 120 may be axially retained in the recess 59 by a cross pin 122 positioned in the breech base 1. The firing pin 118 moves with the breech base 1. Specifically, the firing pin 118 may move relative to the breech head 100 when the breech base 1 and/or the breech head 100 move back and forth during the loading and/or unloading process.

When the weapon is fired, the firing pin 118 passes through a firing pin opening, hole or aperture 124 and protrudes from a breech face or front end 126 of the breech head 100. An end and/or bottom of a cartridge to be fired is positioned adjacent the front end 126. In this example, a spring-loaded pressure pin urges an ejection scallop or element 112 into engagement with a cannelure and/or extractor groove of the cartridge. The clamping force of the ejection scallop 112 may be adjusted such that during the feeding and/or loading process, the ejection scallop 112 radially swings and/or moves over a rear edge of the cartridge and into the extractor groove of the cartridge positioned in the cartridge chamber.

During the locking operation, the breech studs 104 of the breech head 100 interact with the locking lugs 204 of the locking piece 200. During the locking process, the breech studs 104 may initially be positioned between recesses 202 (FIG. 8*a*) of the locking piece 200 and brought into a position in which the first slot surface 62 engages the pin 102. The interaction between the first slot surface 62 and the pin 102 twists and/or rotates the pin 102 within the breech base 1 to align the breech studs 104 with the locking lugs 204. Aligning the breech studs 104 and the locking lugs 204 enables stud surfaces 106 to bear against and/or engage lug surfaces 206 to lock and/or secure the breech head 100 in a linear direction relative to the bore axis 24. In the locked position, the breech head 100 is positioned adjacent to the breech head chamber (not shown). The breech head chamber is positioned at an end of the barrel (not shown). In its assembled state, the barrel may be coupled to the locking piece 200 at a particular position.

As the breech base 1 moves relative to the breech head 100 in the unlocking process, an interaction between the second slot surface 64 and the pin 102 rotates the breech head 100 from the locked position. By rotating the breech head 100, breech studs 104 104*h* and/or 104*v* may be linearly moved rearwardly through the recesses 202 of the locking piece 200.

To improve locking and/or unlocking of the breech assembly 150, in this example, a guide channel 209 (See FIG. 6*c*) is defined by the locking piece 200. The guide channel 209 is to interact with a control breech stud 104*h*' of the breech head 100. The guide channel 209 partially extends along a control cam section, portion or cam lug surfaces 208 (See FIGS. 6, 8).

Figure 6A:
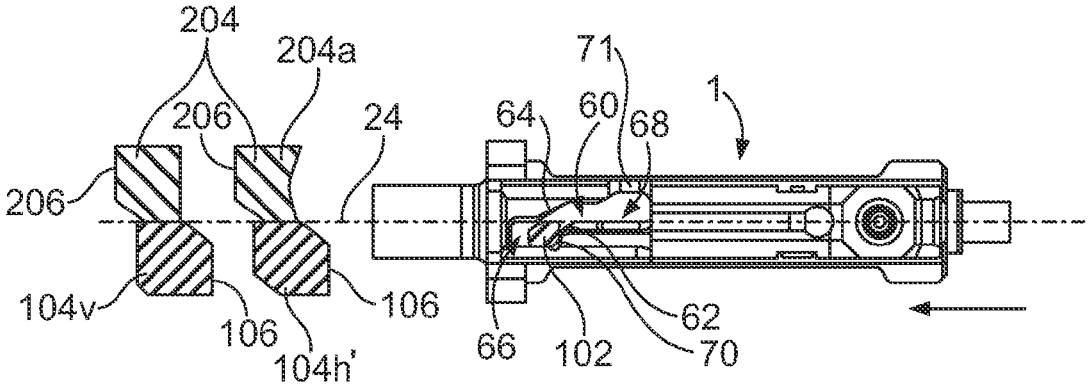
FIGS. 6*a*-6*j* depict schematic representations of different positions of an example breech bolt and example control pin during the locking and unlocking process.
Figure 6B:
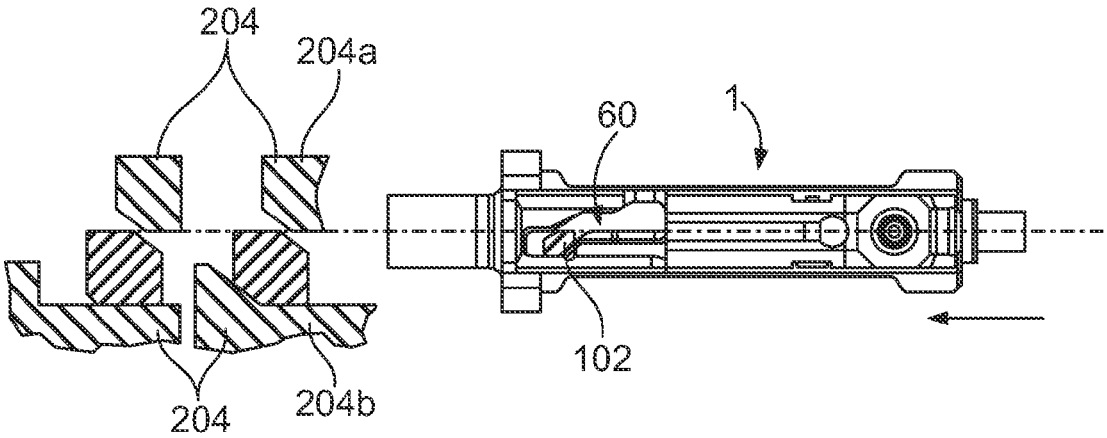
Figure 6C:
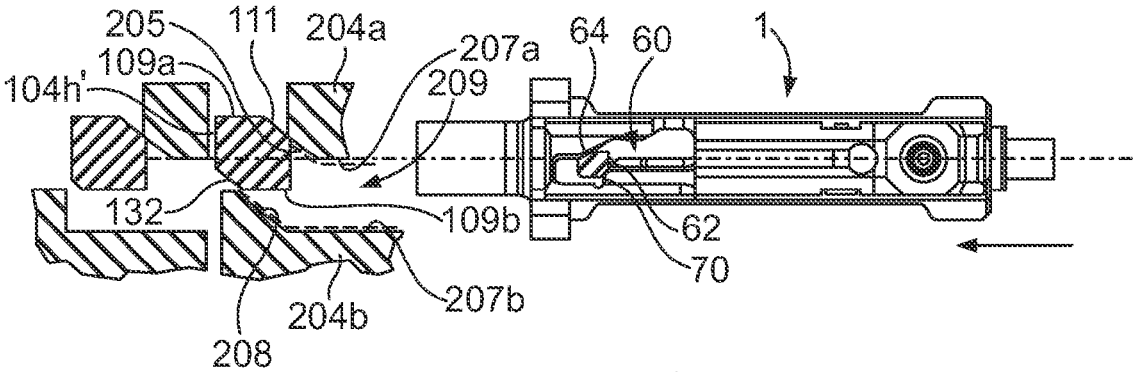

Referring to FIG. 6*c*, the guide channel 209 is illustrated by the dotted boundary line. In this example, the guide channel 209 includes and/or is defined by opposing first and second lug surfaces 207*a*, 207*b* of locking lugs 204*a* and 204*b*, the cam lug surfaces 208 of the locking lug 204*b* and a guide lug surface(s) 205 of the locking lug 204*a*. The guide channel 209 guides and/or leads the movement of the second breech stud 104*h* by engaging and/or interacting with lug side edges 109*a* and 109*b*, a control section, guide zone or first stud surface 132 (FIG. 6*c*) and/or a guide section or second stud surface 111 (FIG. 6*c*) (See FIGS. 6, 7 and 7*a*).

The examples disclosed herein improve the cartridge case extraction process and reduce stresses and/or loads when loading and/or unloading the firearm. The examples disclosed herein also enable smooth movement when loading and/or unloading the firearm.

FIGS. 6*a*-6*j* depict complete cycling movements of the breech assembly 150 when firing a shot. The breech studs 104, 104*h* and 104*v* and the locking lugs 204, 204*a*, 204*b* are illustrated in different positions (e.g., rolled off and/or turned into each other). The corresponding position of the pin 102 in the slot 60 is shown in corresponding cross-hatching (e.g., figure to the right).

Figure 4:
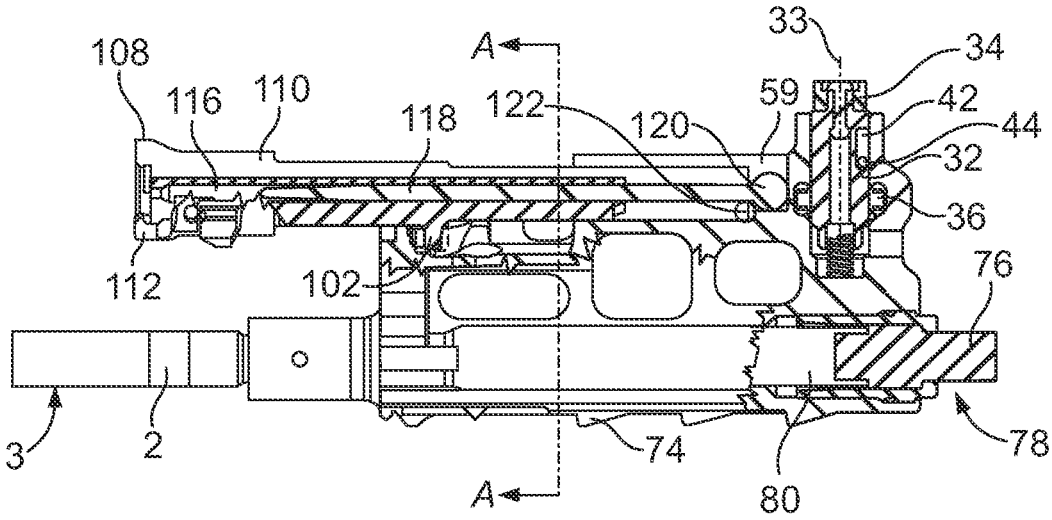
FIG. 4 depicts a longitudinal cross-sectional view of the example breech assembly of FIGS. 1 and 2.
Figure 5:
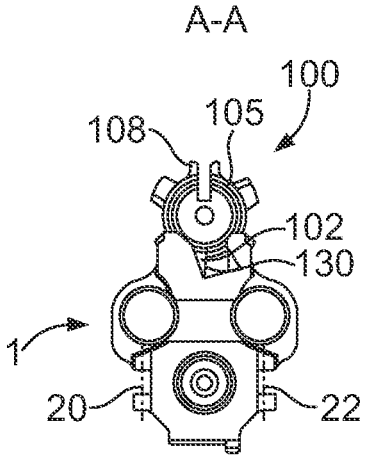
FIG. 5 depicts a cross-sectional view of the example breech assembly along A-A of FIG. 4.

When opening the breech of a cocked weapon and/or firearm, the breech assembly (e.g., breech base 1 and breech head 100) 150 is positioned toward the rear of the casing 6. Stressed breech springs (not shown) engage the breech base 1 and/or are strained on breech spring guide rods (not shown). The breech springs pass through breech spring openings and/or eyes 72. In this example, the breech base 1 is retained in, for example, the rearward position by the trigger mechanism (not shown) on a support projection or catch 74 (FIG. 4). In the unlocked position, the breech head 100 is held in a rotational position by the upper guide rails 16, 18. In the unlocked position, the pin 102 is located in the first slot portion 66. When releasing the breech assembly 150, the catch 74 (FIG. 4) is released and the breech assembly 150 moves forward under the effect the breech springs in the direction of the arrow (See FIGS. 6*a*-6*e*).

When feeding a cartridge, as shown in FIG. 6*a*, the feeding lugs 108 grab a lower edge of a cartridge from a magazine and, with the forward movement of the breech assembly 150, lead the cartridge through the locking piece 200 and into the cartridge chamber of the barrel. An end of the barrel includes the locking piece 200.

When the feeding lugs 108 engage the bottom and/or back of the cartridge, the breech head 100 is moved backwards relative to the breech base 1. As the breech head 100 moves rearwardly, the pin 102 moves backwards in the first slot portion 66 to be adjacent to and/or engage the flat surface 70. The breech studs 104 are received by the locking piece 200 between the locking lugs 204. In this example, a feeding ramp 210 (FIG. 8*a*) is positioned on an upper side of the locking piece 200. During the loading process, the feeding ramp 210 guides and/or pushes the cartridge further into the cartridge chamber of the barrel. Also, during the loading process, the control breech stud 104*h*' is received by and/or introduced into the guide channel 209 (FIG. 6*c*). During the loading process, the first and second lug surfaces 207*a*, 207*b* of the guide channel 209 guide, axially conduct and/or interact with lug side edges 109*a*, 109*b* of the control breech stud 104*h*'.

Figure 6D:
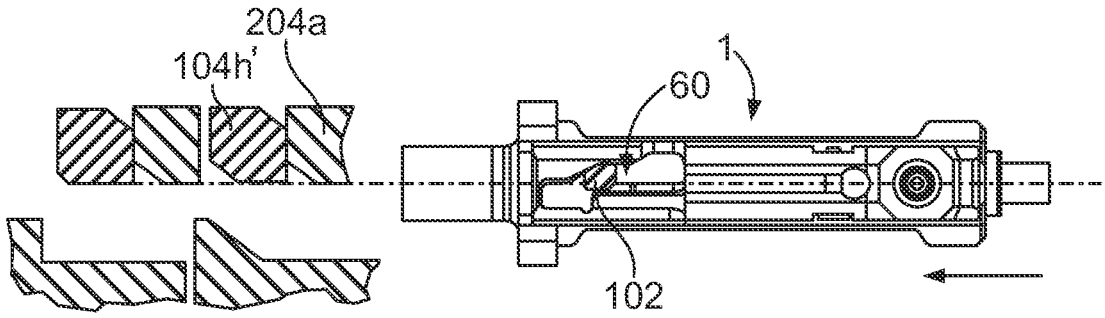
Figure 6E:
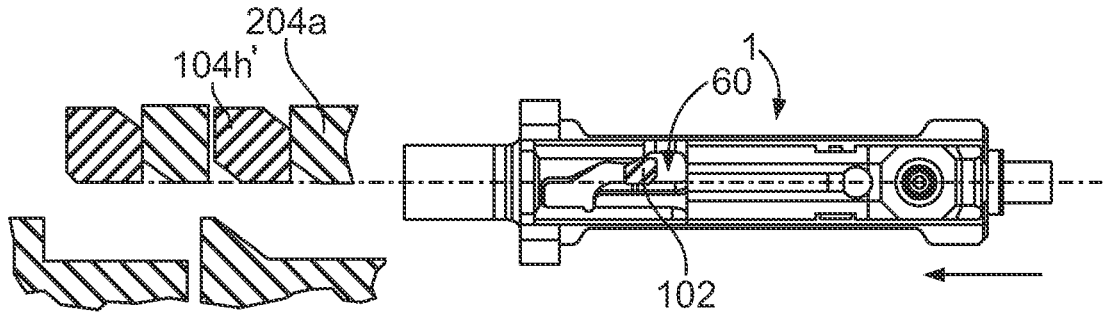

When locking the breech, as shown in FIGS. 6*b*-6*d*, in this example, the breech head 100 is positively guided by the upper guide rails 16, 18 in the casing 6. In some examples, an interaction between the first breech studs 104*v* and the upper guide rails 16, 18 guide the breech head 100 until the first breech studs 104*v* overrun the upper guide rails 16, 18 and are received by the rear locking stud row and/or locking lugs 204. In some examples, an interaction between the second breech studs 104*h* and the upper guide rails 16, 18 guide the breech head 100 until the second breech studs 104*h* overrun the upper guide rails 16, 18 and are received by the rear locking stud row and/or locking lugs 204.

In this example, the breech head 100 remains in the unlocked position until the control breech stud 104*h*' and/or the first stud surface 132 (FIG. 7*a*) engages and/or abuts the cam lug surfaces 208. In this example, the interaction between the first stud surface 132 and the cam lug surfaces 208 rotates and/or transfers angular momentum to the breech head 100 such that the breech studs 104 rotate and/or twist counter-clockwise about one third rotation of the total rotation. When locking the breech, the control breech stud 104*h*' is positioned within the guide channel 209 such that the second stud surface 111 interacts with the guide lug surface 205 and cam lug surfaces 208.

In some example, the unilateral impact of the first stud surface 132 on the cam lug surfaces 208 causes the breech head 100 to be unilaterally loaded and/or to have a unilateral force be imparted thereon. Additionally or alternatively, the unilateral impact of the first stud surface 132 on the cam lug surfaces 208 causes the breech head 100 to move and/or swerve transversally relative to the bore axis 24 and jam.

Figure 8A:
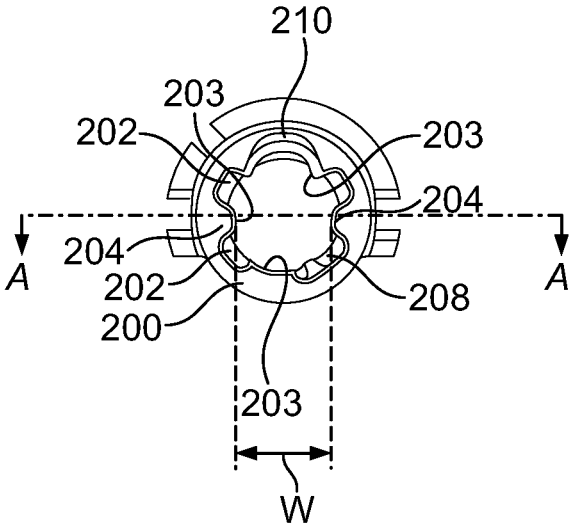
FIGS. 8*a* and 8*b* depict a rear view of an example locking piece and a cross-sectional view of the example locking piece along A-A.
Figure 8B:
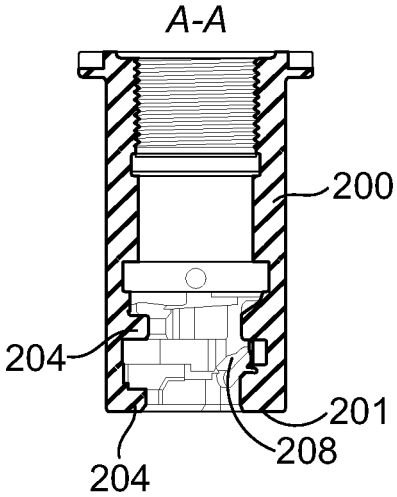

In this example, to substantially prevent the breech head 100 from moving and/or swerving transversally relative to the bore axis 24 and jamming during the loading and/or locking process, the outer diameter of the cylindrical shank surface and/or breech head surface 105 (FIGS. 1, 2 and 5) between the breech studs 104 corresponds to and/or matches the width 'w' (inner diameter; FIG. 8*a*) between the radially inwardly facing and/or inner lug surfaces 203 of the locking lugs 204. During the loading and/or locking process, the breech head surface 105 interacts with and/or rests on the corresponding inner lug surface 203. Because of the interaction between the breech stud 104 and the inner lug surface 203, in this example, the breech head 100 axially moves in and/or relative to the locking piece 200 substantially without twisting, transforming and/or frictional loss. As such, the breech head 100 can move forward, rotate and smoothly lock in and/or relative to the locking piece 200.

Figure 7A:
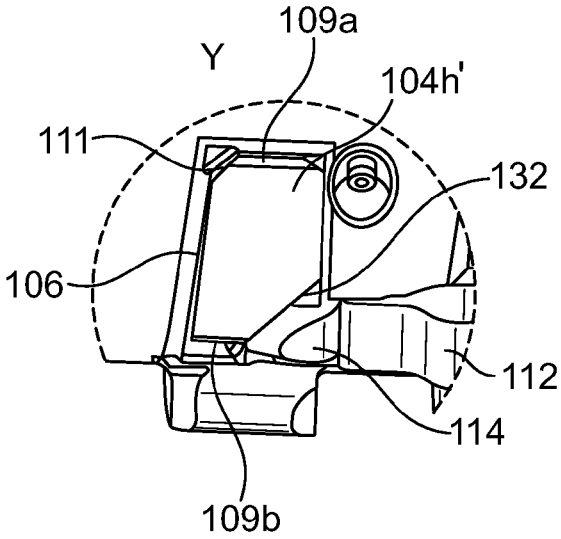
FIG. 7*a* depicts a detailed view of an example breech head of area 'Y' of FIG. 7.

In the locking process, the rear pin surface 128 moves from and/or leaves the area adjacent the flat surface 70 of the slot 60. In the locking process, the first slot surface 62 engages a corresponding control surface of the pin 102, which continues the locking process that was initiated by the interaction and/or relative motion between the cam lug surfaces 208 and the first stud surface 132 (FIGS. 7*a*). In this example, to lock the breech head 100 relative to the locking piece 200, the first slot surface 62 engages and/or rests against a corresponding control surface of the pin 102 to twist and/or rotate the breech head 100 further into a locked position.

In the locking process, the base end of the cartridge engages the front end 126 of the breech head 100 and the ejection scallop 112 snaps into and/or over the extractor groove on the base end of the cartridge.

In this example, by further rotating the breech head 100, the breech studs 104 are positioned adjacent to and/or arrive in front of the locking lugs 204. Additionally, by further rotating the breech head 100, the rear faces and/or stud surfaces 106 are substantially and/or completely flush with the front faces and/or lug surfaces 206 of the locking lugs 204. When the breech studs 104 are positioned adjacent to and/or arrive in front of the locking lugs 204, the breech head 100 rotates approximately a further two-thirds of the total breech head 100 rotation.

In this example, the locking front faces and/or stud surfaces 106 and the lug surfaces 206 are inclined at a self-locking angle relative to the bore axis 24. The remainder of the locking of the breech head 100 may be caused by an interaction between the breech studs 104 and the locking lugs 204 that causes rotation and/or a screwing motion of the breech head 100, for example. The surface coupling between the breech studs 104 and the locking lugs 204 may be self-coupling such that axial movement and/or action of the breech head 100 may not cause the breech studs 104 to release themselves from the locked position.

The locking procedures described above relate to a pre-control and/or initial locking process and a final and/or definitive locking process. In some examples, in the initial locking process, interaction between the cam lug surfaces 208 and/or the first stud surface 132 cause the breech head 100 to rotate one-third of the total rotation and, in the final locking process, locking of the breech head 100 occurs without significant rebound movements and/or without significant forces being imparted (e.g., in a soft way). The angle and/or inclination of the front faces and/or stud surfaces 106 (FIG. 7*a*) and/or lug surfaces 206 enables and/or facilitates the locking process and substantially reduces internal frictional resistance encountered during the locking process.

In some examples, the angle and/or inclination of the cam lug surfaces 208 corresponds to and/or is similar to a slope, inclination, tilt and/or angle of the first stud surface 132 (FIG. 7*a*), the guide lug surface 205 and/or the second stud surface 111. In some examples, to enable the locking and/or breech movement process to occur smoothly and/or softly, the angle and/or inclination of the cam lug surfaces 208 corresponds to and/or is similar to the slope, inclination, tilt and/or angle of the first slot surface 62 and/or the guide surface on the pin 102. The first slot surface 62 may be used in transitioning and/or moving the breech head 100 to the locked position. In some examples, the slope, inclination, tilt and/or angle of the first slot surface 62 is related and/or corresponds to an inclination angle, slope, etc., of the cam lug surfaces 208 such that the rotational acceleration of the locked breech head 100 is increased during the transition of the breech head 100 from the cam lug surfaces 208 to the first slot surface 62. The first slot surface 62 may be used in the locking process.

In some examples, to enable the pin 102 to move with relatively little if any side play over the length of the slot 60 and, especially, through the first and second slot surfaces 62, 64, a tilt, angle, slope, inclination, etc., of the first slot surface 62 corresponds to an angle, slope, tilt, inclination, etc., of the second slot surface 64. The second slot surface 64 may be used in the unlocking process.

When firing a cartridge and/or round, as shown in FIG. 6*d*, the pin 102 is positioned adjacent the second slot portion 68 and the breech head 100 is linearly fixed and/or secured and interlocked in a circumferential direction in the locking piece 200. With the breech head 100 secured, the breech base 1 moves forward relative to the breech head 100 causing the firing pin 118 to move forward in the firing pin channel 116 and extend from the firing pin aperture 124 and ignite the cartridge. During the firing process, the pin 102 moves backwards in the second slot portion 68 relative to the forward moving breech base 1 until a front side 61 of the breech base 1 engages the backward-looking front end and/or surface 201 (FIG. 8*b*) of the locking piece 200. Engagement between the front side 61 and the surface 201 stops the forward movement of the breech base 1 relative to the locking piece 200.

After firing the cartridge, due to gas pressure that acts on the piston 4, the breech base 1 is moved and/or pushed backwards against the force of the breech springs. Initially, the breech base 1 moves backwards relative to the breech head 100 (e.g., in the direction arrow of FIGS. 6*f*-6*j*). Movement of the breech base 1 moves and/or pulls the firing pin 118, via the ball head 120, backwards into the firing pin channel 116. As the breech base 1 moves backwards, the pin 102 moves forward to the second slot portion 68 and engages the second slot surface 64 used for unlocking (FIG. 6*f*).

Figure 6F:
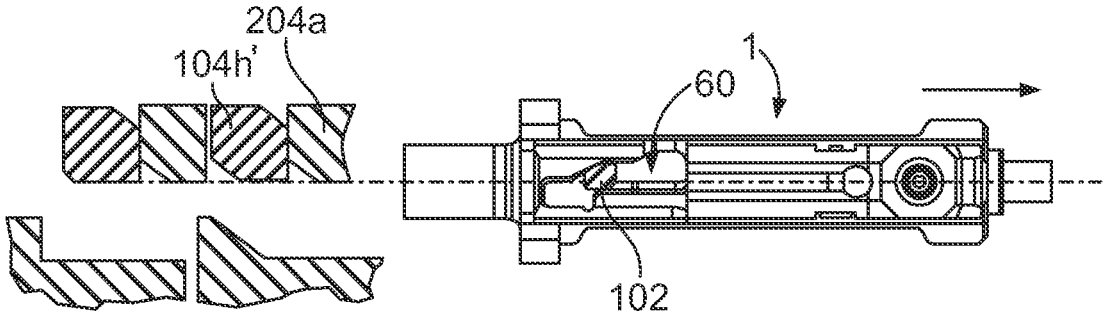
Figure 6G:
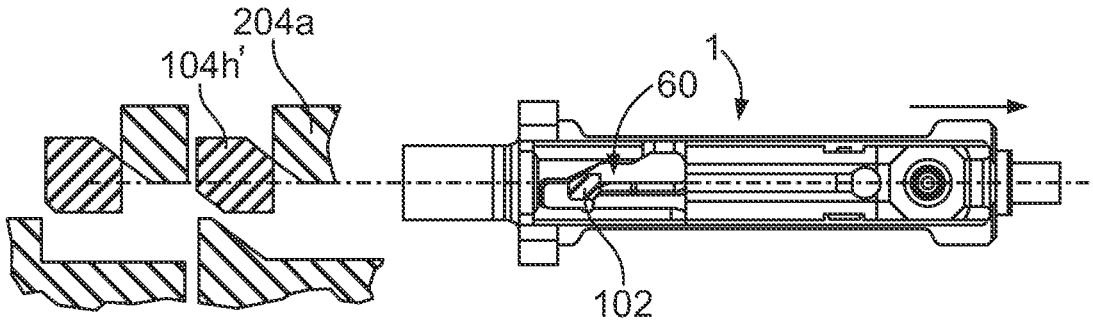
Figure 6H:
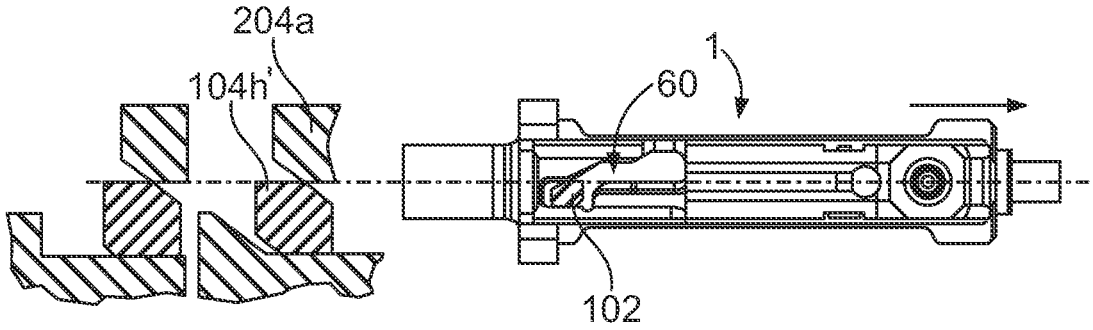

When unlocking the breech head 100 and/or pulling out and/or removing the cartridge, as shown in FIGS. 6*f*-6*h*, in this example, due to the beginning unlocking motion, the breech studs 104 are turned out and/or removed from the area of the locking lugs 204 (FIG. 6*g*). The unlocking motion may relax and/or decrease the contact pressure between the front end 126 of the breech head 100. During the unlocking motion, the ejection scallop 112 may engage and/or twist into the extractor groove of the cartridge case. The rotation motion of the breech head 100 may be caused and/or initiated by an interaction between the second slot surface 64 and the pin 102. After the cartridge is fired, in some examples, the cartridge case may expand and be firmly wedged in the cartridge chamber. During the unlocking motion, the first stud surface 132 may be supported by the cam lug surfaces 208 and the cartridge casing may be removed from the cartridge chamber by a screwing motion that has an increased force and reduced axial velocity (e.g., from the positions shown in FIGS. 6*g*-6*h*).

Similar to the locking process, as the breech head 100 is being unlocked, movement and/or unlocking of the control breech stud 104*h*' is caused by the first stud surface 132 and the second stud surface 111 interacting with the cam lug surfaces 208 of the locking lug 204*b* and the guide lug surface 205 of the locking lug 204*a* in the guide channel 209.

Figure 6I:
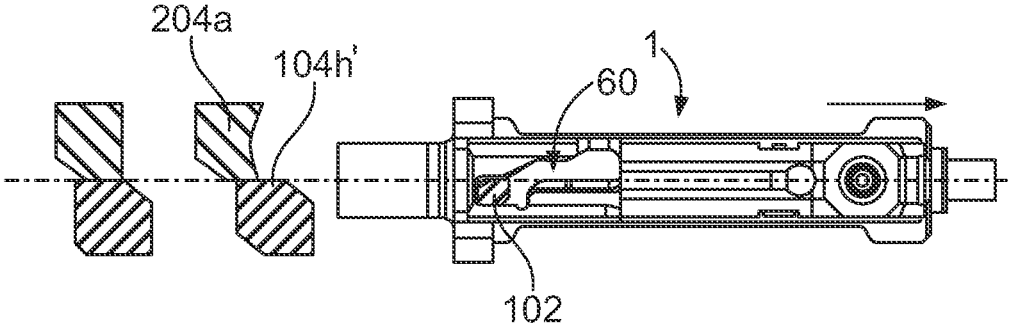
Figure 6J:
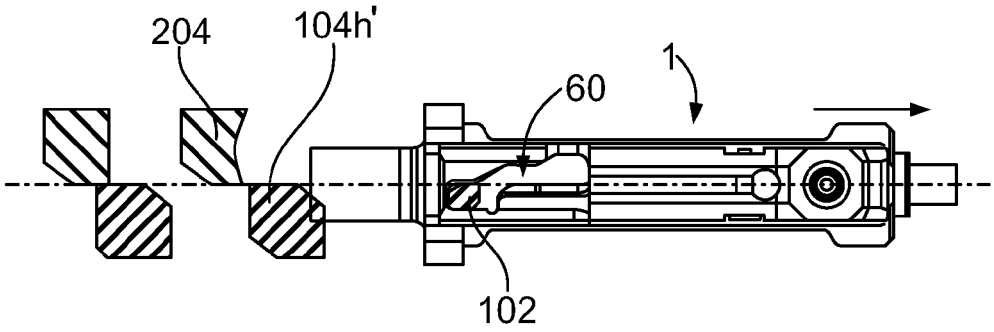

In the completely rotated position, the breech studs 104 are positioned flush with the recesses 202 of the locking piece 200. Movement of the breech base 1 and the interaction between the pin 102 engaging a front end of the first slot portion 66 moves the breech head 100 and the cartridge case toward the rear of the firearm (FIG. 6*i*). The cartridge case is held relative to the breech head 100 by the ejection scallop 112. As the breech base 1 and the breech head 100 move rearwardly, the breech head 100 and the cartridge case exit the cartridge chamber and the locking piece 200 (FIG. 6*j*).

As the breech base 1 and the breech head 100 move rearwardly, the breech head 100 is positioned adjacent the upper guide rails 16, 18 and the ejector ejects the cartridge case through a window, aperture and/or opening 3 of the piston rod 23 and from the firearm. The ejector may protrude into the ejection slot. As the breech base 1 moves further toward the rear of the firearm, a stop pin or stop 76 of the breech base 1 engages a bottom plate (not shown) of the firearm. In this example, the stop pin 76 is an extension of the piston rod 2 and is positioned on the bottom of the breech base 1.

In some examples, the stop pin 86 is cushioned from within the breech base 1 by a mechanical buffer or buffer 78. The buffer 78 may absorb a relatively high and/or large amount of mechanical energy because of the spring assembly (e.g., a ring spring assembly) 80. Thus, a reduction in an amount of kinetic energy of the breech assembly 150 during recoil may occur. When the trigger is released, the breech assembly 150 may be locked in place via the catch 74. After the last round is fired from a belt and/or magazine, the breech assembly 150 is retained in the locked position (e.g., the rearward position).

The examples disclosed herein relate to the breech guide 30 for a breech assembly 150 including the breech base 1 and the breech head 100 that can be used with firearms and/or weapons. The firearms may be automatic firearms, semi-automatic firearms, etc. The breech assembly 150 includes a shaft 32 positioned in the breech base 1 and/or the breech head 100. The first roller 34 is positioned on the shaft 32 and may be used for controlling a weapon component such as, for example, a belt feeder mechanism and/or a cartridge feeder mechanism, etc. The second roller 35 is positioned on the shaft 32 for guiding the breech assembly 150, the breech base 1 and/or the breech head 100 relative to the upper guides rails 16, 18. In this example, the shaft 32 extends along an axis 33 substantially perpendicular to the bore axis 24. In this example, the first roller 34 and the second roller 35 are substantially coaxially arranged relative to the axis 33.

The examples disclosed herein relate to a breech arrangement 1, 100 for a weapon (e.g., automatic firearm) with the breech guide 30.

Because of required close tolerances, some known breech guide devices are complicated and costly to manufacture. Additionally, some of these known breech guide devices may only enable limited operability of the breech guide device. For example, breech guides including guide rails may jam because of the large amount of play required to substantially prevent the guide rails from being affected by contaminants and/or buildup. Alternatively, high friction forces may occur if less play, and/or narrow guide rails or pins are provided. High friction forces may cause increased wear and reduce available control forces for weapon capabilities (e.g., conveyor feed).

The examples disclosed herein substantially overcome the disadvantages of the known breech assemblies.

As disclosed above, the breech guide 30 is to be used with the breech assembly 150, 1, 100 of an automatic weapon. The breech assembly 150, 1, 100 includes the shaft 32 positioned therein. The first roller 34 is arranged on the shaft 32 for controlling a weapon component (e.g., a belt feeder). The second roller 36 may be arranged on the shaft 32 for guiding the breech assembly 150, 1, 100 along the upper guide rails 16, 18. The shaft 32 extends along the axis 33 substantially perpendicular to the bore axis 24. The first and second rollers 34, 36 may be substantially coaxially arranged relative to the axis 33.

The examples disclosed herein relate to the breech assembly 150, 1, 100 of a firearm (e.g., an automatic firearm) with the breech guide 30.

As disclosed above, the examples disclosed herein relate to the breech assembly 150, 1, 150 that includes the shaft 32 positioned within the breech assembly 150, 1, 100 and the first roller 34 arranged on the shaft 32. The first roller 34 may be used for controlling a weapon component. The second roller 36 may be arranged on the shaft 32. The second roller 36 may at least partially guide the breech assembly 150, 1, 100 relative to the upper guide rails 16, 18. The shaft 32 extends along the axis 33 substantially perpendicular to the bore axis 24. The first and second roller 34 and 36 may be substantially coaxially arranged relative to one another and/or the axis 33.

As disclosed above, the examples disclosed herein relate to a firearm (e.g., a rapid fire weapon) with the breech assembly 150, 1, 100. The example breech assembly 150 may include one or more rollers (e.g., control and/or guide elements) on the shaft 32. However, in accordance with the teachings of this disclosure, in some examples, the breech assembly 150 includes the first roller 34 and the second roller 36.

As disclosed above, the rollers 34 and 36 are substantially coaxially mounted on the shaft 32 relative to the axis 33. The rollers 34 and/or 36 may be similarly or differently sized. For example, the first roller 34 may be larger or smaller than the second roller 36. In some examples, the roller 34 and/or 36 may laterally protrude from the breech assembly 150 on and/or adjacent to the top of the breech assembly 150, etc.

During movement of the breech assembly 150, the breech base 1, etc., the second roller 36 is guided by the upper guide rails 16, 18. The upper guide rails 16, 18 may be formed by the casing 6, designed as a function unit with the second roller 36, etc. For example, the upper guide rails 16, 18 may be designed and/or provided in the casing 6 such that the second roller 36 slides and/or rolls within the upper guide rails 16, 18 as the breech assembly 150 moves. Because of the coaxial arrangement of the rollers 34, 36, transverse forces acting on the first roller 34 may cause the first roller 34 to roll, slide, move, etc., into and/or in the casing 6 and/or the semi-monocoques, portions elements 8, 10. The examples disclosed herein enable high efficiency of the breech by enabling low friction and/or sliding resistances.

As disclosed above, the first roller 34 and/or the second roller 36 are arranged on the shaft 32 such that the rollers 34 and/or 36 can move and/or slide relative to the shaft 32. The moveable coupling and/or sliding mount of the rollers 34 and/or 36 on the shaft 32 enables high dynamic peak loads with relatively low frictional resistance. In some example, at least some of the components of the breech assembly include self-lubrication, anti-friction coatings.

As disclosed above and in accordance with the teachings of this disclosure, the first roller 34 and the shaft 32 are axially and/or slidably arranged in the breech base 1. The breech base 1 at least partially surrounds the shaft 32.

As disclosed above and in accordance with the teachings of this disclosure, the first roller 34 and the shaft 32 are movably mounted in the breech base 1 and biased therein by the spring 40. As such, the first roller 34 and the shaft 32 are axially movable against the force of the spring 40 to enable the shaft 32 to be retained in, for example, the breech base 1. To enable the first roller 34 to be completely submerged and/or retained in the breech base 1, the spring 40 may be sized and/or have a particular spring force and the first roller 34 and the shaft 32 may be sized and/or shaped accordingly. In some example, the first roller 34 may be designed at the top of the breech assembly 150 to enable the lid 56 of the cartridge feeder to be closed, engage the first roller 34 via the lever 50 and/or lever legs 52 and/or 54 and for the first roller 34 and the shaft 32 to be moved within the breech base 1 without damage.

As disclosed above and in accordance with the teachings of this disclosure, the shaft 32 passes through the second roller 36 and is displaceable relative to the second roller 36. Thus, the first roller 34 may be axially shifted and/or moved by the shaft 32 independent of any movement of the second roller 36 to enable a simple component-saving design.

As disclosed above and in accordance with the teachings of this disclosure, the second roller 36 is retained in the breech assembly 150, 1, 100 adjacent the upper guide rails 16, 18 and/or in a portion of the breech assembly 150, 1, 100 that corresponds to the upper guide rails 16, 18. The interaction between the second roller 36 and the upper guide rails 16, 18 enables the second roller 36 to be reliably guided and/or to increase the guidance and/or stability of the breech base 1 in the loading and/or unloading process. The second roller 36 may enable the breech base 1 to be supported relative to the casing 6 during the loading and/or unloading process.

As disclosed above and in accordance with the teachings of this disclosure, the shaft 32 may be secured against the action of the actuating element by a safety lock. The safety lock may be any suitable securing device such as, for example, a pin, bolt, screw, etc. In some examples, when mounting the breech guide 30 in the breech assembly 150, 1, 100, the spring 40 is inserted and then the second roller(s) 36 and the shaft (32) are inserted into the retaining aperture 38 of the breech base 1 and/or breech assembly 150, 1, 150. Once inserted into the retaining aperture 38, the second roller 36 may be retained within the retaining aperture 38 by, for example, the shaft 32.

As disclosed above and in accordance with the teachings of this disclosure, the first and second rollers 34 and 36 may be rollers that interact with, roll on and/or engage respective surfaces of the upper guide rails 16, 18 and the first and second lever legs 52, 54. The shaft 32 may provide a control and/or guide axis for the first and/or second rollers 34 and/or 36. In some examples, independently mounting the first and second rollers 34 and 36 enables and/or provides relatively little guide play between the second roller 35 and the upper guide rails 16, 18 and/or between the first and second lever legs 52, 54. Thus, the first roller 34 and/or the second roller 36 may transfer high actuator and/or control forces to the lever 50 of the belt feeder with relatively low friction. Counter forces created by the interaction between the rollers 34 and/or 36 and the lever 50 may be transferred to the casing 6 via the second roller 36, for example. The movement of the breech is enabled and/or further facilitated due to low frictional resistance and/or forces of the first roller 34 and/or the second roller 36.

As disclosed above and in accordance with the teachings of this disclosure, as the breech assembly 150, 1, 100 moves, the rollers 34 and/or 36 may rotate in opposite directions. Because the rollers 34 and 36 are supported on opposing sides, as the breech assembly 150, 1, 100 moves and activates the lever 50, the rollers 34 and 36 may rotate in opposite directions, thereby enabling the stability of the breech assembly 150, 1, 100 to be increased.

As disclosed above and in accordance with the teachings of this disclosure, the first roller 34 and/or the second roller 36 may have a crowned surface and/or crowned roller surface. A crowned cam roller used for the first roller 34 may be less likely to jam with, for example, the lever 50. In some examples, the coaxial design of the crowned roller cam (e.g., the first roller 34) and the guide roller (e.g., the second roller 36) enable the first and second rollers 34 and 36 to support one another, enable the breech assembly 150, 1, 100 to be guided during the loading and/or unloading process and/or enable manufacturing tolerances to be increased. In some examples, providing the rollers 34 and/or 36 with convex rolling surfaces may improve the rolling characteristics at different axial angles of the rollers 34 and/or 36 relative to the upper guide rails 16, 18 and/or the lever legs 52, 54.

As disclosed above and in accordance with the teachings of this disclosure, during the forward and rearward movement of the breech assembly 150, 1, 100, the first roller 34 acts on the lever legs 52, 54 to control the supply of cartridges to the firearm. In some examples, the first roller 34 may be positioned on the upper side of the breech base 1 and the lever 50 may be arranged and/or designed on a cartridge feeder cover and/or lid 56. In some examples, during the loading and/or unloading process, the first roller 34 controls a belt feeder mechanism on the lid 56 and transfers the alternatively acting restoring forces through the second roller 36 to the casing 6 with relatively little play and/or friction.

As disclosed above and in accordance with the teachings of this disclosure, the first roller 34 moves within the lever legs 52, 54 defined by the lever 50 and controls the oscillating pivoting movement of the lever 50 that drives the conveyor mechanism for feeding cartridges. The low tolerance of the guide rails 16, 18 and/or lever legs 52, 54 may reduce lateral acceleration of the weapon that may affect the accuracy of the weapon.

As disclosed above and in accordance with the teachings of this disclosure, the examples described herein relate to a compact breech guide device with an increased belt feeding force, lower motion resistance of the breech device and/or assembly that improves the functionality of the weapon and enables the firearm to cycle relatively smoothly with relatively low transversal acceleration. The examples disclosed herein increase the reliability, accuracy, etc., of firearms and/or weapons.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A breech guide for use with a breech assembly of a firearm, comprising:

a support element positioned within the breech assembly;

a control element on the support element, the control element is adapted to control a cartridge-feeder mechanism of the firearm;

a guide element on the support element, the guide element is adapted to guide the breech assembly relative to guide rails of the firearm, wherein the support element extends along an axis of symmetry substantially perpendicular to a bore axis, the control element and the guide element being substantially coaxially positioned relative to the axis of symmetry, wherein the support element comprises a shaft, the control element comprises a first roller, and the guide element comprises a second roller.

2. The breech guide of claim 1, wherein one or more of the control element or the guide element are moveable relative to the support element.

3. The breech guide of claim 1, wherein the support element and the control element are axially positioned within a casing of the firearm, the casing to at least partially retain at least one of the control element or the support element.

4. The breech guide of claim 3, wherein the control element and the support element are movably mounted within the casing against a force of a biasing element, the biasing element being positioned within the casing.

5. The breech guide of claim 1, wherein the support element extends through and is displaceable relative to the guide element.

6. The breech guide of claim 1, wherein the guide element is retained by the breech assembly along the axis of symmetry and adjacent the guide rails.

7. The breech guide of claim 1, wherein, as the breech assembly moves, the control element is to roll on surfaces of lever legs and the guide element is to roll on surfaces of the guide rails.

8. The breech guide of claim 1, wherein, as the breech assembly moves, the control element is to roll in a first direction and the guide element is to rotate in a second direction, the first direction opposite the second direction.

9. The breech guide of claim 1, wherein one or more of the control element or the guide element comprises a convex rolling surface.

10. The breech guide of claim 1, wherein, as the breech assembly moves, the control element is to engage lever legs of a lever to control the cartridge-feeder mechanism.

11. The breech guide of claim 1, further comprising:

a breech base;

a breech head at least partially mounted within the breech base, the breech head comprising a plurality of breech studs; and a locking piece comprising a plurality of locking lugs, wherein one of the locking lugs comprises a rearward facing cam section, wherein, when moving the breech head during an unlocking movement, stud surfaces of the breech studs are to be released from lug surfaces of the locking lugs.

12. The breech guide of claim 11, wherein, when moving the breech head during the unlocking movement, a first stud surface of a control breech stud is to cause the breech head to rotate and remove a cartridge from a cartridge chamber, the first stud surface to be supported by the rearward facing cam section.

13. The breech guide of claim 12, wherein, when moving the breech head during a locking movement, the rearward facing cam section is to interact with the first stud surface to rotate a pin in a slot of the breech base from an unlocked position to a locked position in which a first slot surface of the slot engages the pin to rotate the breech head to convert linear motion of the breech head to rotational movement.

14. A firearm, comprising:

a breech guide, comprising:

a shaft positioned within the breech guide;

a first roller on the shaft, the first roller to control a cartridge-feeder mechanism of the firearm; and a second roller on the shaft, the second roller to guide a breech assembly relative to guide rails of the firearm, wherein the shaft extends along an axis of symmetry substantially perpendicular to a bore axis, and wherein the first and second rollers are substantially coaxially positioned relative to the axis of symmetry.

15. The firearm of claim 14, wherein the breech assembly comprises a breech base and a breech head at least partially mounted within the breech base, the breech head comprising a plurality of breech studs, and further comprising a locking piece comprising a plurality of locking lugs, wherein one of the locking lugs comprises a rearward facing cam section, wherein, when moving the breech head during an unlocking movement, stud surfaces of the breech studs are to be released from lug surfaces of the locking lugs.

16. The firearm of claim 15, wherein, when moving the breech head during the unlocking movement, a first stud surface of a control breech stud is to cause the breech head to rotate and remove a cartridge from a cartridge chamber, the first stud surface to be supported by the rearward facing cam section.

17. The firearm of claim 16, wherein, when moving the breech head during a locking movement, the rearward facing cam section to is interact with the first stud surface to rotate a pin in a slot of the breech base from an unlocked position to a locked position in which a first slot surface of the slot engages the pin to rotate the breech head to convert linear motion of the breech head to rotational movement.

18. The firearm of claim 14, wherein the first roller and the shaft are movably mounted within the breech guide against a force of a biasing element, the biasing element being positioned within the breech guide.

19. A firearm, comprising:

a breech guide, comprising:

a shaft positioned within the breech guide;

a first roller on the shaft, the first roller to control a cartridge-feeder mechanism of the firearm;

a second roller on the shaft, the second roller to guide a breech assembly relative to guide rails of the firearm, wherein the shaft extends along an axis of symmetry substantially perpendicular to a bore axis, the first and second rollers being substantially coaxially positioned, the breech assembly comprising a breech base and a breech head at least partially mounted within the breech base, the breech head comprising a plurality of breech studs; and a locking piece comprising a plurality of locking lugs, wherein one of the locking lugs comprises a rearward facing cam section, wherein, when moving the breech head during an unlocking movement, stud surfaces of the breech studs are to be released from lug surfaces of the locking lugs.

* * * * *